US006049907A

United States Patent [19]

Palomo

[11] Patent Number: 6,049,907

[45] Date of Patent: Apr. 18, 2000

[54] GOWN TIE

[75] Inventor: Joseph A. Palomo, Ingleside, Ill.

[73] Assignee: Allegiance Corporation, McGaw Park, Ill.

[21] Appl. No.: 09/013,422

[22] Filed: Jan. 26, 1998

[51] Int. Cl.[7] ..... A41D 13/12

[52] U.S. Cl. ..... 2/51; 2/114

[58] Field of Search ..... 2/48, 50, 51, 52, 2/114, 46, 300, 338, 901, 69

[56] References Cited

U.S. PATENT DOCUMENTS

| | | | |
|---|---|---|---|
| 3,648,290 | 3/1972 | Hartigan | 2/114 |
| 3,824,625 | 7/1974 | Green | 2/114 |
| 3,843,971 | 10/1974 | Delanty et al. | 2/114 |
| 3,935,596 | 2/1976 | Allen, Jr. et al. | 2/114 |
| 4,019,207 | 4/1977 | Newman et al. | 2/51 |
| 4,040,124 | 8/1977 | Zoephel | 2/51 |
| 4,075,716 | 2/1978 | Collins | 2/114 |
| 4,255,818 | 3/1981 | Crowley et al. . | |
| 4,290,148 | 9/1981 | Roberts | 2/51 |
| 4,451,931 | 6/1984 | Wichman | 2/51 |
| 4,555,811 | 12/1985 | Shimalla | 2/51 |
| 4,587,671 | 5/1986 | Rodriguez, Jr. et al. . | |
| 4,622,699 | 11/1986 | Spriggs | 2/114 |
| 4,674,132 | 6/1987 | Stein et al. | 2/114 |
| 4,982,448 | 1/1991 | Kogut | 2/51 |
| 4,996,722 | 3/1991 | Jimenez et al. . | |
| 5,414,867 | 5/1995 | Bowling et al. | 2/51 |

*Primary Examiner*—Amy B. Vanatta
*Attorney, Agent, or Firm*—Paul E. Schaafsma

[57] ABSTRACT

The present invention provides a gown 10 having a fastening structure which allows for easy securing of the gown 10 on a health care professional. The present invention provides a gown 10 having a front 14, two back side portions 16, 18, with two sleeves 20, 22 secured thereto. A tie 27 is provided that is attached to the gown 10. Secured to the front portion of the gown is an adhesive surface 25. The area of adhesion provided is preferably wider than the width of the tie 27 and of sufficient length to properly adhere the tie 27. To secure the gown 10 on the health care personnel, the tie 27 is extended around the back to the front area 14 and secured to the adhesive area 25.

58 Claims, 3 Drawing Sheets

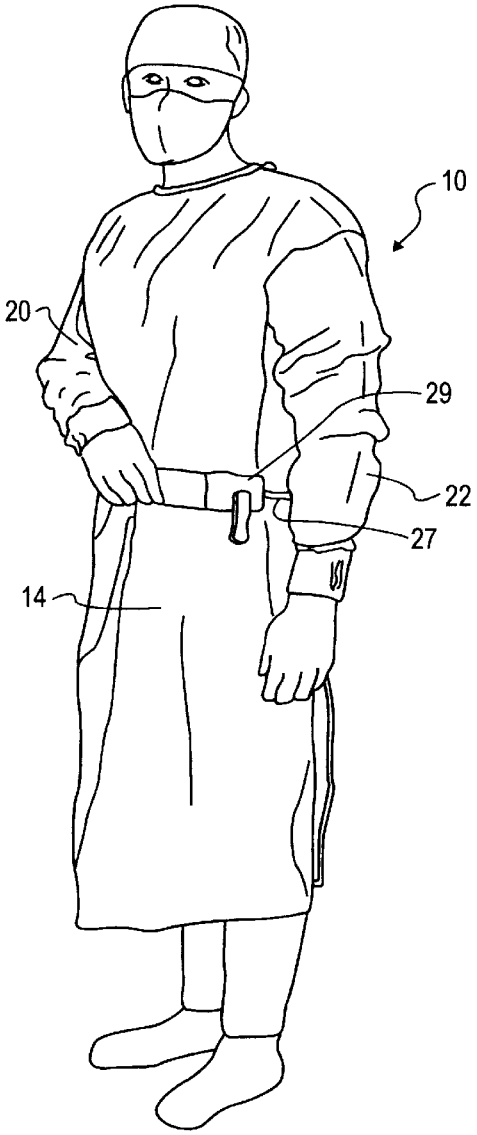
FIG. 4
FIG. 5
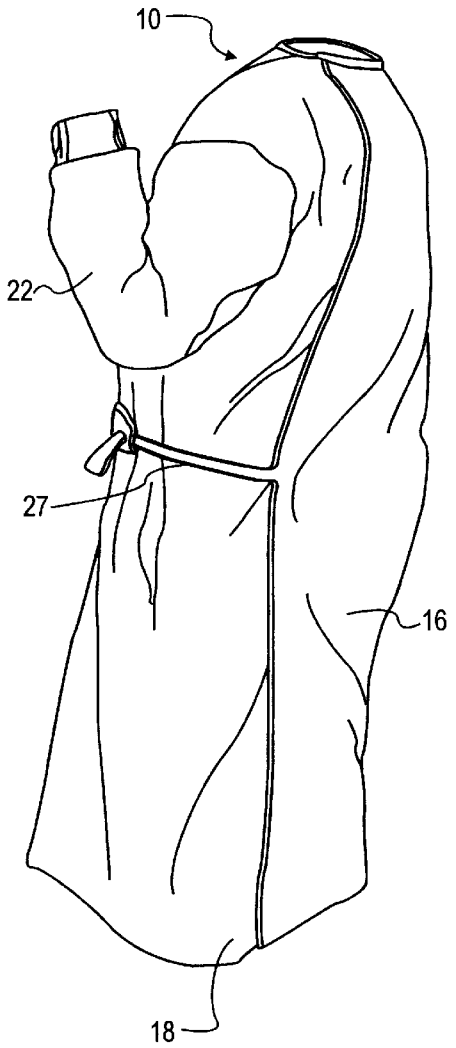

GOWN TIE

FIELD OF THE INVENTION

The present invention relates in general to medical gowns and relates, in particular, to a surgical gown tie application.

BACKGROUND OF THE INVENTION

Surgical gowns have been used in the medical community to protect health care professionals from liquids and microorganisms during surgical and other procedures. Single use surgical gowns are typically made of a non-woven, disposable fabrics. Such gowns typically include a single body panel or a front panel, a pair of back panels which are connected to the sides of the front panel and extend away from the front panel, and a pair of sleeves which are provided at the juncture of the front and side panels. The front panel covers the front of the health care professional during the procedure. The back panels are secured around and overlap each other to cover the rear of the health care professional by a tying structure. Typical surgical gowns will include two outer ties and two inner ties. The inner ties are utilized to secure the inside back of the gown. The outer ties are used to ensure that the back of the gown overlaps around the rear of the health care professional.

The outer tie includes a short length tie which is typically secured on the front left side of the gown. The outer tie further includes a longer length tie that is attached to the back of the gown. When used, the longer tie is wrapped around the back of the gown and tied to the shorter front tie.

While such ties do secure the gown around the health care personnel, such arrangements have several drawbacks. The health care professional wearing the gown is typically assisted by a health care assistant to maintain the sterility of the gown. The health care assistant grasps the long tie, walks the long tie around the health care professional, whereupon the health care professional would tie the long tie to the short tie. Securing the two ties together in a knotted relationship takes time and involves an awkward tying procedure. Additionally, once the gown is secured and the ties are knotted, it becomes time consuming and may compromise sterility when repositioning the ties to adjust the gown.

What would thus be advantageous would be a surgical gown having a fastener which could be easily fastened. The fastening system would further allow repositioning so that the gown could be adjusted. Such system would further provide these advantages in a low cost structure as the gowns upon which the fastening system will be used are typically disposable one time use garments.

BRIEF DESCRIPTION OF THE INVENTION

The present invention provides a surgical gown having a fastening structure which allows for easy securing of the gown on a health care professional. The present invention enables the fastening mechanism to be repositioned thus allowing the repositioning of the gown on the health care personnel. The present invention provides these advantages in a low cost design which does not add to the cost of the disposable garment.

The present invention provides a gown having a single body panel or a front, two back side portions, with two sleeves secured thereto. A long tie is provided that is attached to the back of the gown. Secured to the front portion of the gown is an adhesive surface. The area of adhesion provided is preferably wider than the width of the gown tie and of sufficient length to properly adhere the tie. To secure the gown on the health care personnel, the tie is extended around the back panel to the front area and secured to the adhesive area. This shortens the time required and eliminates the fumbling which occurs when gowns are tied in accordance with the prior art. Additionally, if a readjustment of the gown needs to be made during the procedure, the gown can be easily readjusted by removing the long tie from the adhesive surface and repositioning it in the appropriate position.

BRIEF DESCRIPTION OF THE DRAWINGS

FIG. 4 is a front perspective view of the gown of FIG. 1 with the tie secured to the adhesion area.

FIG. 5 is a rear perspective view of the gown of FIG. 1 with the tie secured on the adhesion area.

DETAILED DESCRIPTION OF THE DRAWINGS

Figure 1:
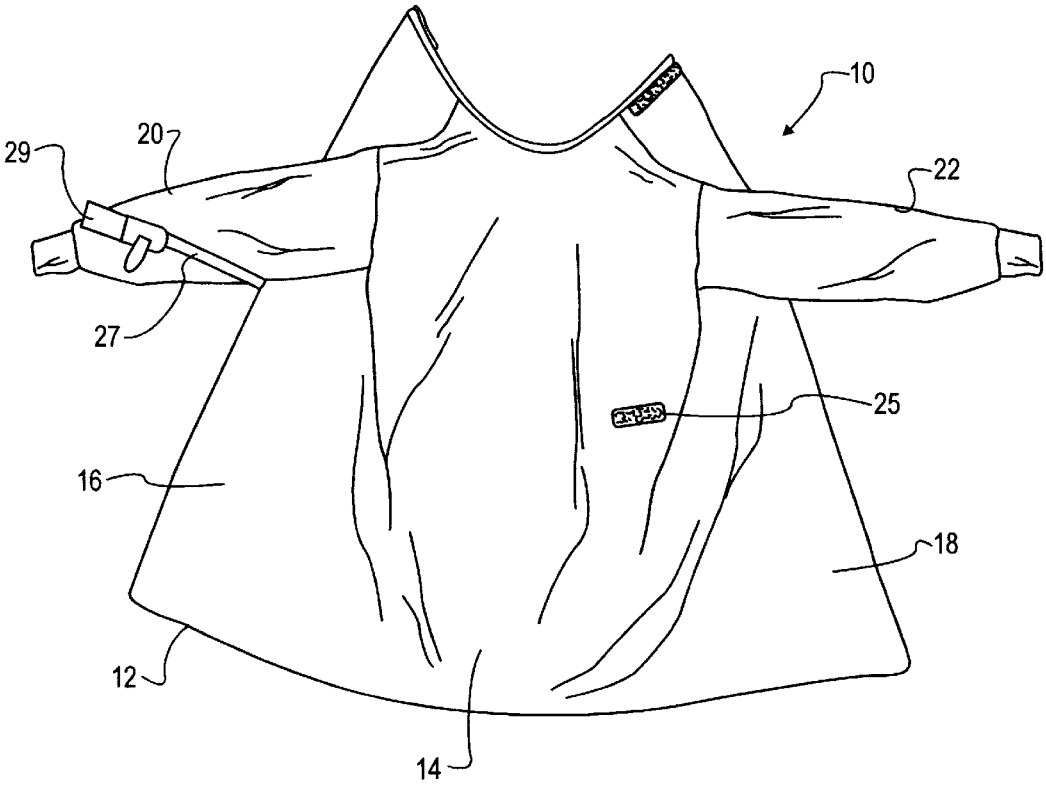
FIG. 1 is a front view of a gown made in accordance with the principals of the present invention.

Referring first to FIG. 1, a typical medical gown 10 is seen. The gown includes a body panel 12 which defines a front panel 14 and a pair of back panels 16, 18. Extending from each side of the body panel 12 are sleeves 20, 22. To wear the gown 10, the health care professional inserts their hand into the sleeves 20, 22 with the front panel 14 of the gown facing outward. The gown 10 is extended onto the health care professional's arms and the back panels 16, 18 are wrapped around the rear portion of the health care professional in an overlapping fashion, as seen generally in FIGS. 4 and 5.

While in the past such gowns were made of a reusable woven fabric, the typical gowns today are made of a non-woven disposable fabric. Use of such disposable fabric enables one time use without the need to launder such gowns. Of course, use of disposable gowns requires use of relatively inexpensive fabrics. Examples of such fabrics include spunlaced or hydroentangled fabrics which are formed by entangling the fibers about each other in a repeating pattern, usually with high velocity streams of water; spun bond fabric formed from filaments that have been extruded, drawn and laid on a continuous belt and bonded or wet laid or wet formed fabric which is formed in a web by filtering an aqueous suspension of fibers onto a screen or belt or perforated drum. Alternatively, the fabric could be a melt blown fabric which is formed by a web forming press that extrudes molten resin and draws the resin with hot, high velocity air to form fine filaments onto a collecting screen combined with a spun bond layer. In the preferred embodiment described herein, the fabric is a composite with a melt blown layer sandwiched between two spun bond layers. Of course, additional fabrics such as, for example, fabrics having a plurality of laminated layers are within the scope of the present invention.

In order to secure the garment on a health care professional in the prior art devices, a long tie was provided on a back panel of the gown. A short tie was provided on the front of the gown on the side opposite the side to which the long tie was secured. When the gown was placed on the health care professional, with the back panels overlapping each other to cover the rear of the professional, the long tie was extended around the side of the health care professional to the short tie and secured in a knotted relationship.

Referring back to FIG. 1, the front panel 14 defines a securement area which in the preferred embodiment of the invention, consists of an area of adhesive 25 to which a tie 27 is secured. The adhesive 25 preferably comprises an area wider than the width of the tie 27 and of sufficient length to securely hold the tie 27. In the preferred embodiment described herein, the tacky area of adhesive 25 is preferably two inches in width and one inch in length.

In the preferred embodiment, the adhesive 25 should be a non-tacky adhesive which acts like a pressure sensitive adhesive. The adhesive 25 should maintain a thin profile on the fabric of the gown 10. The adhesive 25 should provide a peel strength sufficient to secure the tie 27 on the gown 10 with no inadvertent peeling. In particular, the adhesive 25 should combine for a high sheer strength to avoid disconnection during the movement of the health care professional. The adhesive 25 should preferably be non-toxic for use in the medical environment. Additionally for use in the medical environment, the adhesive 25 must be capable of withstanding sterilization procedures, such as irradiation, ethylene oxide, autoclaving or the like.

The preferred adhesive in the present invention is a pressure sensitive adhesive which provides a non-tacky surface. It has been found that an adhesive system available from 3M Corporation of St. Paul, Minn. which utilizes a SJ-3101 fastener fulfills the required pressure sensitive adhesion while providing a non-tacky surface. The tie 27 can be preferably made of polyester, polyvinyl chloride or polyurethane. Alternatively, the tie 27 can be made of a non-woven with an end portion of polyester, polyvinyl chloride or polyurethane. In one embodiment of the invention, the tie 27 is secured directly to the adhesive 25.

Figure 2:
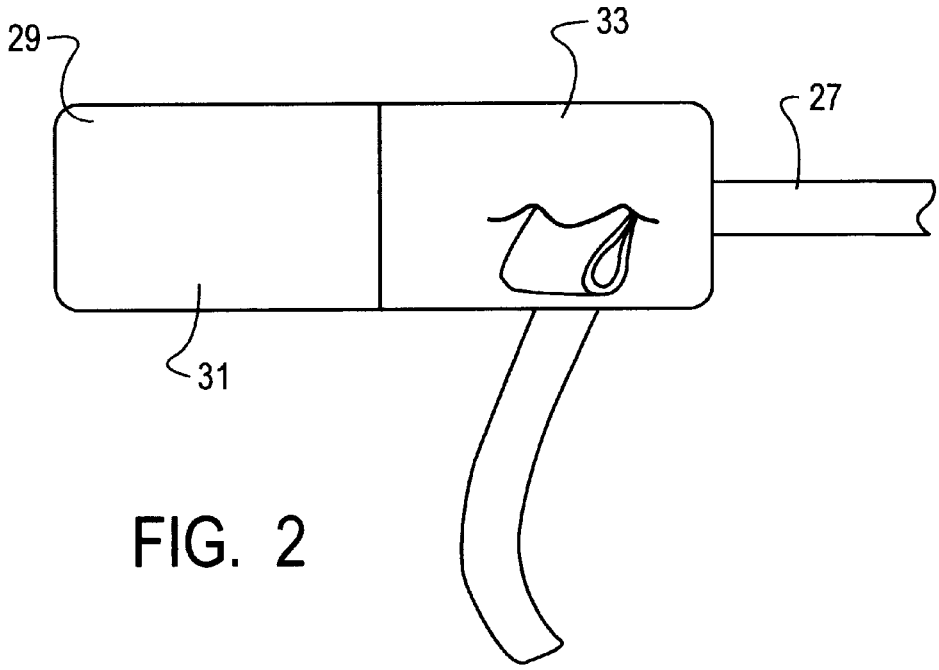
FIG. 2 is a detailed view of the outside of a transfer tab of the gown of FIG. 1.
Figure 3:
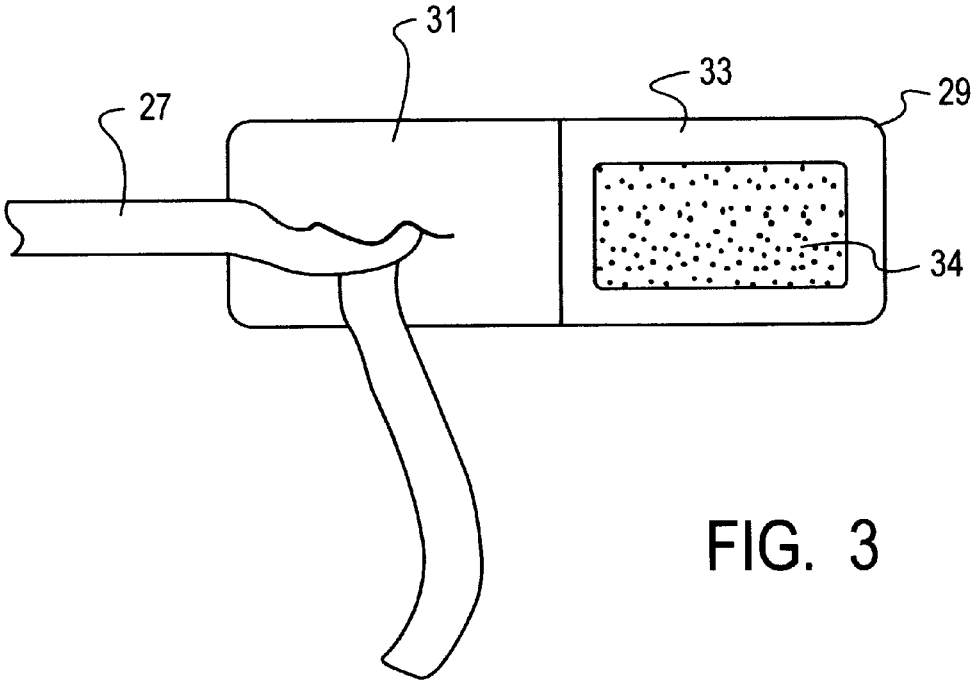
FIG. 3 is a detailed view of the inside of the transfer tab of the gown of FIG. 1.

Referring now to FIGS. 2 and 3, a target securement area, which in the preferred embodiment consists of a transfer tab made in accordance with the principles of the present invention is seen. The tie 27 is connected at the outer periphery to the transfer tab 29. The transfer tab 29 is preferably made of a cardboard material. The transfer tab is sectioned into two areas: a sterile area 31 which is not touched by heath care professionals and a handle area 33 which is grasped by heath care professionals.

In the transfer tabs of the prior art, the transfer tabs were secured to both the long tie and the short tie prior to placement of the gown on the health care professional. In the prior art, the health care assistant would grasp the transfer tab, pull the transfer tab loose from the short tie, walk the long tie around the health care professional, whereupon the health care professional would tie the long tie to the short tie.

The transfer tab 29 of the present invention includes on the inside on the handle section 33 a pressure sensitive non-tacky surface 34. In this preferred embodiment, the SJ-3101 fastener available from 3M Corporation is used with a SJ-3102 target material also available from 3M Corporation, St. Paul, Minn. Prior to securing the gown 10 on the health care professional, the transfer tab 29 is engaged to the adhesive surface 25 of the gown 10. Upon placing the gown 10 on the health care professional, the transfer tab 29 and tie 27 are removed from the adhesive area 25 by grasping the handle section 33, walked around the back of the health care professional, and the tie 27 is secured to the adhesive area 25 of the gown 10.

It should be understood that various changes and modifications to the preferred embodiment described herein will be apparent to those skilled in the art. For example, while the preferred embodiment described herein is for single use gowns, multiple use gowns can be within the scope of the present invention. In such multiple use gowns, an adhesive material capable of withstanding multiple washes without losing its adhesive qualities, such as a hook and loop fastener, can be used. Such changes and modifications can be made without departing from the spirit and scope of the present invention and without diminishing its intended advantages. Therefore, it is intended that such changes and modifications be covered by the appended claims.

What is claimed is:

1. A gown for donning by a person, comprising:

a body and two sleeves;

the body defining a front portion and two side portions;

one of the side portions including a tie member secured thereto, the tie member including a transfer tab having an area defined as a target securement area; and the front portion defining a cooperating securement area, said target securement area of the transfer tab being initially attached to said cooperating securement area of the front portion without said tie overlapping the other of said side portions prior to donning, and said target securement area of the transfer tab being removable from said cooperating securement area of the front portion and said target securement area of the transfer tab being reattached to said cooperating securement area of the front portion with said tie overlapping the other of said side portions subsequent to donning by a person.

2. The gown of claim 1, wherein the gown is made of a disposable fabric.

3. The gown of claim 2, wherein the disposable fabric is a non-woven.

4. The gown of claim 3, wherein the non-woven is a spun-bonded material.

5. The gown of claim 3, wherein the non-woven is a melt blown material.

6. The gown of claim 3, wherein the non-woven is a spunlaced or hydroentangled material.

7. The gown of claim 2, wherein the fabric includes a plurality of laminated layers.

8. The gown of claim 2, wherein the fabric is a melt blown material combined with a spun bond material.

9. The gown of claim 1, wherein the tie is made of a polyester.

10. The gown of claim 1, wherein the tie is made of a polyvinyl chloride.

11. The gown of claim 1, wherein the tie is made of a non-woven material.

12. The gown of claim 1, wherein the target securement area is polyvinyl chloride.

13. The gown of claim 2, wherein the fabric is a composite with a melt blown layer sandwiched between two spun bond layers.

14. The gown of claim 1, wherein the target wherein the target securement area is polyester.

15. The gown of claim 1, wherein the transfer tab is sectioned into a sterile area and a handle area.

16. The gown of claim 1, wherein the transfer tab is made of a cardboard material.

17. A gown for donning by a person, comprising:

a body and two sleeves;

the body defining a front portion and two side portions;

one of the side portions including a tie member secured thereto, the tie member including a transfer tab having an area defined as a target securement area comprising a non-tacky adhesive; and the front portion defining a cooperating securement area comprising a non-tacky adhesive, said target securement area being initially attached to said cooperating securement area without said tie overlapping the other of said side portions prior to donning, and said target securement area being removeable from said cooperating securement area and reattached to said cooperating securement area with said tie overlapping the other of said side portions subsequent to donning by a person.

18. The gown of claim 17, wherein the tie is made of polyester.

19. The gown of claim 17, wherein the tie is made of polyvinyl chloride.

20. The gown of claim 17, wherein the tie is made of a non-woven material.

21. The gown of claim 17, wherein the transfer tab is sectioned into a sterile area and a handle area.

22. The gown of claim 17, wherein the transfer tab is made of a cardboard material.

23. The gown of claim 17, wherein the gown is made of a disposable fabric.

24. The gown of claim 23, wherein the fabric includes a plurality of laminated layers.

25. The gown of claim 23, wherein the fabric is a melt blown material combined with a spun bond material.

26. The gown of claim 23, wherein the fabric is a composite with a melt blown layer sandwiched between two spun bond layers.

27. The gown of claim 23, wherein the fabric is a non-woven.

28. The gown of claim 27, wherein the non-woven is a spun-bonded material.

29. The gown of claim 27, wherein the non-woven is a melt blown material.

30. The gown of claim 27, wherein the non-woven is spunlaced or hydroentangled material.

31. A gown for donning by a person, comprising:

a body and two sleeves;

the body defining a front portion and two side portions;

one of the side portions including a tie member secured thereto, the tie member including a transfer tab having an area defined as a target securement area comprising a pressure sensitive adhesive; and the front portion defining a cooperating securement area comprising a pressure sensitive adhesive, said target securement area being initially attached to said cooperating securement area without said tie overlapping the other of said side portions prior to donning, and said target securement area being removeable from said cooperating securement area and reattached to said cooperating securement area with said tie overlapping the other of said side portions subsequent to donning by a person.

32. The gown of claim 31, wherein the tie is made of polyester.

33. The gown of claim 31, wherein the tie is made of polyvinyl chloride.

34. The gown of claim 31, wherein the tie is made of a non-woven material.

35. The gown of claim 31, wherein the transfer tab is sectioned into a sterile area and a handle area.

36. The gown of claim 31, wherein the transfer tab is made of a cardboard material.

37. The gown of claim 31, wherein the gown is made of a disposable fabric.

38. The gown of claim 37, wherein the fabric includes a plurality of laminated layers.

39. The gown of claim 37, wherein the fabric is a melt blown material combined with a spun bond material.

40. The gown of claim 37, wherein the fabric is a composite with a melt blown layer sandwiched between two spun bond layers.

41. The gown of claim 37, wherein the fabric is a non-woven.

42. The gown of claim 41, wherein the non-woven is a spun-bonded material.

43. The gown of claim 41, wherein the non-woven is a melt blown material.

44. The gown of claim 41, wherein the non-woven is spunlaced or hydroentangled material.

45. A gown for donning by a person, comprising:

a body and two sleeves;

the body defining a front portion and two side portions;

one of the side portions including a tie member secured thereto, the tie member including a transfer tab having an area defined as a target securement area comprising one of a hook or a loop fastener; and the front portion defining a cooperating securement area comprising the other of the hook or the loop fastener, said target securement area being initially attached to said cooperating securement area without said tie overlapping the other of said side portions prior to donning, and said target securement area being removeable from said cooperating securement area and reattached to said cooperating securement area with said tie overlapping the other of said side portions subsequent to donning by a person.

46. The gown of claim 45, wherein the tie is made of polyester.

47. The gown of claim 45, wherein the tie is made of polyvinyl chloride.

48. The gown of claim 45, wherein the tie is made of a non-woven material.

49. The gown of claim 45, wherein the transfer tab is sectioned into a sterile area and a handle area.

50. The gown of claim 45, wherein the transfer tab is made of a cardboard material.

51. The gown of claim 45, wherein the gown is made of a disposable fabric.

52. The gown of claim 50, wherein the fabric includes a plurality of laminated layers.

53. The gown of claim 50, wherein the fabric is a melt blown material combined with a spun bond material.

54. The gown of claim 51, wherein the fabric is a composite with a melt blown layer sandwiched between two spun bond layers.

55. The gown of claim 51, wherein the fabric is a non-woven.

56. The gown of claim 55, wherein the non-woven is a spun-bonded material.

57. The gown of claim 55, wherein the non-woven is a melt blown material.

58. The gown of claim 55, wherein the non-woven is spunlaced or hydroentangled material.

* * * * *